US005197504A

United States Patent [19]

Howe

[11] Patent Number: 5,197,504

[45] Date of Patent: Mar. 30, 1993

[54] SELF-CONTAINED TENT SYSTEM

[75] Inventor: Robert Howe, Oakland, Calif.

[73] Assignee: The North Face, Berkeley, Calif.

[21] Appl. No.: 732,773

[22] Filed: Jul. 19, 1991

Related U.S. Application Data

[63] Continuation of Ser. No. 557,162, Jul. 23, 1990, abandoned.

[51] Int. Cl.[5] ..... E04H 15/36

[52] U.S. Cl. ..... 135/102; 135/104; 135/106; 135/179

[58] Field of Search ..... 135/104, 102, 105, 106, 135/109, 114, 115, 119, 87

[56] References Cited

U.S. PATENT DOCUMENTS

| | | | |
|---|---|---|---|
| 2,543,684 | 2/1951 | Blanchard . | |
| 3,176,699 | 4/1965 | Rollins . | |
| 3,863,659 | 2/1975 | Gillis . | |
| 3,874,397 | 4/1975 | Oberhaus . | |
| 3,986,519 | 10/1976 | Gillis . | |
| 4,099,533 | 7/1978 | Gillis . | |
| 4,192,333 | 3/1980 | Sato . | |
| 4,193,413 | 3/1980 | Watts et al. . | |
| 4,195,651 | 4/1980 | Watts et al. . | |
| 4,198,996 | 4/1980 | Keable et al. . | |
| 4,265,260 | 5/1981 | Gillis . | |
| 4,414,993 | 2/1983 | Gillis . | |
| 4,569,362 | 2/1986 | Fidler, Jr. | 135/104 |
| 4,706,696 | 11/1987 | Gillis | 135/102 |
| 4,716,918 | 1/1988 | Hayashida et al. | 135/93 |
| 4,827,958 | 5/1989 | Cantwell et al. | 135/104 |

FOREIGN PATENT DOCUMENTS

3213781A1 4/1982 Fed. Rep. of Germany .

OTHER PUBLICATIONS

The North Face 1978 Spring-Summary Catalogue, p. 20.

*Primary Examiner*—Richard E. Chilcot, Jr.
*Assistant Examiner*—Lan M. Mai
*Attorney, Agent, or Firm*—Limbach & Limbach

[57] ABSTRACT

A new and improved dome-type tent with a membrane suspended from a plurality of flexible tent poles. The membrane has a plurality of O-rings distributed about its outer surface in a plurality of paths separated one from the other with one of the flexible poles extending through the O-rings along each path of O-rings and with the pole being securely attached at one of its ends to the membrane in such a manner that the end remains attached to the tent membrane even when the tent is in the unassembled state for storage. The other end of each of the flexible poles is attached to the membrane so that when the tent is assembled and erected, the tent poles will exert a radially outward force on the membrane; however, when the tent is to be disassembled for storage, this other end of each of the flexible poles is detached from the membrane and the O-rings of each path of O-rings are slid along the respective flexible poles towards the end of the pole which remains attached to the membrane during disassembly and storage and the tent poles and membrane, together with the O-rings are folded together in a compact arrangement for storage.

17 Claims, 3 Drawing Sheets

SELF-CONTAINED TENT SYSTEM

This is a continuation of application Ser. No. 07/557,162, filed Jul. 23, 1990, now abandoned.

FIELD OF THE INVENTION

The present invention relates generally to a new and improved, dome-like, tent structure primarily for back-packing tents. In particular, this invention relates to a novel tent design which may be quickly and easily assembled and disassembled, and wherein all components of the tent structure may be stored together in a semi-assembled state during storage, thus making for the quick assembly and disassembly of the tent.

BACKGROUND OF THE INVENTION

The prior art discloses a variety of tents which are used as outdoor shelters particularly in areas where hiking and camping are common sports. The designs of these tents run the gamut and may include designs where the membrane and poles are made of heavy duty materials which are quite heavy and cumbersome to transport and store and which are usually carried from one place to the next in a vehicle. Many prior art tents also include lightweight materials which are not at all suitable for inclement conditions and which may simply be used purely for casual recreational purposes and not at all by the serious camper and/or hiker.

A substantial number of the current tent structures makes use of a strong membrane which is suspended from a number of flexible support poles or rods which form the frame or support structure for the tent. This is true of the tents which are designed to be carried by a single individual as a backpack. Regardless of the design of the prior art tents, particularly back-packing tents, known to applicant or disclosed in the prior art which will be subsequently discussed, all previous tent structures which make use of a membrane and any supporting structure (poles, rods, etc.) requires for storage that the membrane and the poles and other support structure be completely disassembled and separately stored. This can obviously become cumbersome and awkward and result in an increased load where the entire tent structure must be carried as a back-pack and by one individual. Also, having the tent structure completely disassembled during storage would require significantly more time to re-assemble the tent and would usually require more than one person to assemble the structure for use.

A representation of the state of the relevant art in tent manufacturing is disclosed in a number of U.S. and foreign patents, non of which teaches or even suggests a tent structure either similar to applicant's structure or one which would make applicant's structure obvious to one skilled in the art. In fact, nearly all of the prior art structures all require a complete disassembly of the membrane from the pole support structure for storage.

For example, U.S. Pa. No. 4,706,696 to Gillis teaches an orbit-type tent structure in which the tent membrane is kept under tension by at least two sets of stress poles. When the tent is disassembled for storage, the poles and other support elements for the structure are held together in their proper relationship by means of an elastic cord. Even if the pole assembly of the '696 patent does in some way remain attached to the tent membrane during disassembly and storage, the '696 patent does not disclose a structure which may be as conveniently and as quickly assembled as does applicant's invention as will be described herein. U.S. Pat. Nos. 4,414,993 and 4,265,260, both to Gills, related to a flexible vault structure which has a plurality of stressed poles form which a membrane is suspended with various means of attaching the membrane to the poles. U.S. Pat. No. 4,198,996 to Keable, et al. discloses a portable camper-type structure which may be elevated when assembled for use. The structure makes use of a plurality of O-rings which are slidably mounted by various tubular members which form a part of the structure's foundation. Both U.S. Pat. Nos. 4,099,533 and 3,986,519 issued to Gillis and each discloses a flexible tent structure with at least tow series of rows of poles (all poles in a row being substantially parallel to each other) with the rows of poles intersecting the other rows of poles and with the poles being stabilized at the points of intersection by fittings, such as rings which permit the poles to slide relative to each other within a limited degree. U.S. Pat. No. 3,874,397 to Oberhaus discloses a dome-like tent structure with a foldable support frame which includes stays and a clamping device and which supports a cloth covering when erected and assembled for use. U.S. Pat. No. 2,543,684 to Blanchard discloses a relatively lightweight tent, particularly useful to explorers, which tent may be easily and quickly assembled and disassembled and requires no guy ropes or tent pins. German Patent No. 3,213,781 which appears o be one counterpart of Canadian Patent No. 1,166,926 and directed to the same invention issued to Kramer, and discloses a tent structure which comprises a plurality of elongated flexible and intersecting rods from which a membrane is suspended by means of a plurality of hooks affixed to the membrane at preselected locations. The hooks are affixed to the membrane and are designed to be removably affixed to flexible rods at various points of intersection of the rods.

SUMMARY OF THE INVENTION

While all of the prior art references and designs disclose some feature(s) in tent design which is useful and desirable in constructing lightweight tents which may be quickly and easily assembled and/or disassembled, it is still desirable to have a tent structure which is particularly suitable to be carried in a backpack and which may be stored together with all of the tent components in a compact assembly with the components still partially assembled, and attached together thus allowing for quick and easy re-assembly. Accordingly, there is still a need in the tent industry for a lightweight tent which makes use of flexible support poles from which a membrane is suspended and which may conveniently and comfortably be carried as a backpack and which may be quickly and easily assembled and disassembled for storage with both poles and membranes stored together in a still partially-assembled state. The present invention answers this need and teaches such a new and improved tent structure with several additional advantages and characteristic features becoming more apparent to one skilled in the art from the subsequent description of the drawings and further from the detailed description of the preferred embodiments of the invention in which like reference numerals refer to like parts.

DETAILED DESCRIPTION OF PREFERRED EMBODIMENTS

Figure 1:
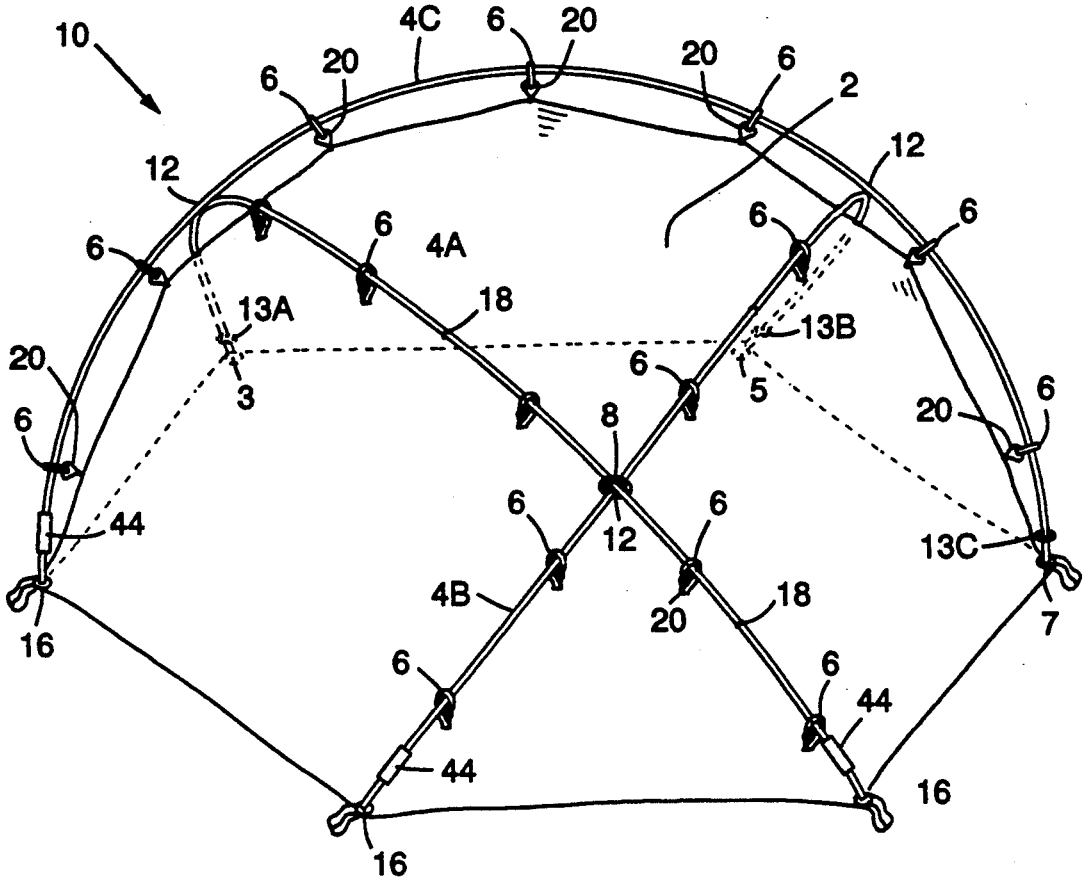
FIG. 1 is a perspective view of one embodiment of a tent designed and constructed in accordance with the teachings of the present invention.

To better understand the present invention and its advantages, reference is made to FIG. 1 which illustrates a dome-shaped tent structure 10 with a membrane 2 being suspended from flexible poles 4*a, b* and *c* by means of a series of O-rings 6. Flexible poles 4*a, b* and *c* may have sections 18 which may be folded for compactness during storage of the tent. The series of O-rings 6 are attached to membrane 2 by means of a flexible web 20; however, O-rings 6 may be attached to web 20 by any other suitable and flexible device or material which will allow membrane 2 together with O-rings 6 to be slidably moved along poles 4*a, b* and *c* when tent 10 is to be disassembled for storage.

Each of poles 4*a, b* and *c* is semi-permanently attached to membrane 2 at one end of each of poles 4*a, b* and *c*. In this embodiment membrane 2 is attached to both ends of poles 4*a, b* and *c* by means of a grommet or O-ring 16 through which poles 4*a, b* and *c* is extended and further by means of a pin tip 9 (see FIG. 7) which is inserted securely into a cavity 11 in both ends of poles 4*a, b* and *c* and which operates to maintain the attachment of poles 4*a, b* and *c* to membrane 2. The attachment of membrane 2 to poles 4*a, b* and *c* preferably remains intact at one end of each of poles 4*a, b* and *c* even during disassembly and storage of the tent. Each of poles 4*a, b* and *c* is attached at its other end 3, 5 and 7 respectively by the same means of inserting a pin tip 9 securely into a cavity 11 in each of the other ends of poles 4*a, b* and *c* (see FIG. 7.) During disassembly and storage of the tent, the other ends 3, 5 and 7 of poles 4*a, b* and *c* are each detached from membrane 2 for storage. When pole ends 3, 5, and 7 are detached from membrane 2 pole tip 9 is temporarily removed to release membrane 2. Upon release of membrane 2, tip 9 is again inserted into cavity 11 for safekeeping and later use. It is to be understood that both ends of poles 4*a, b* and *c* may be completely detached from membrane 2 and fully re-assembled for later use; however, the advantage of the quick and easy re-assembly of the tent may not be fully realized as is the case where at least one end of each of poles 4*a, b* and *c* remains attached to membrane 2 during disassembly and storage.

Figure 4:
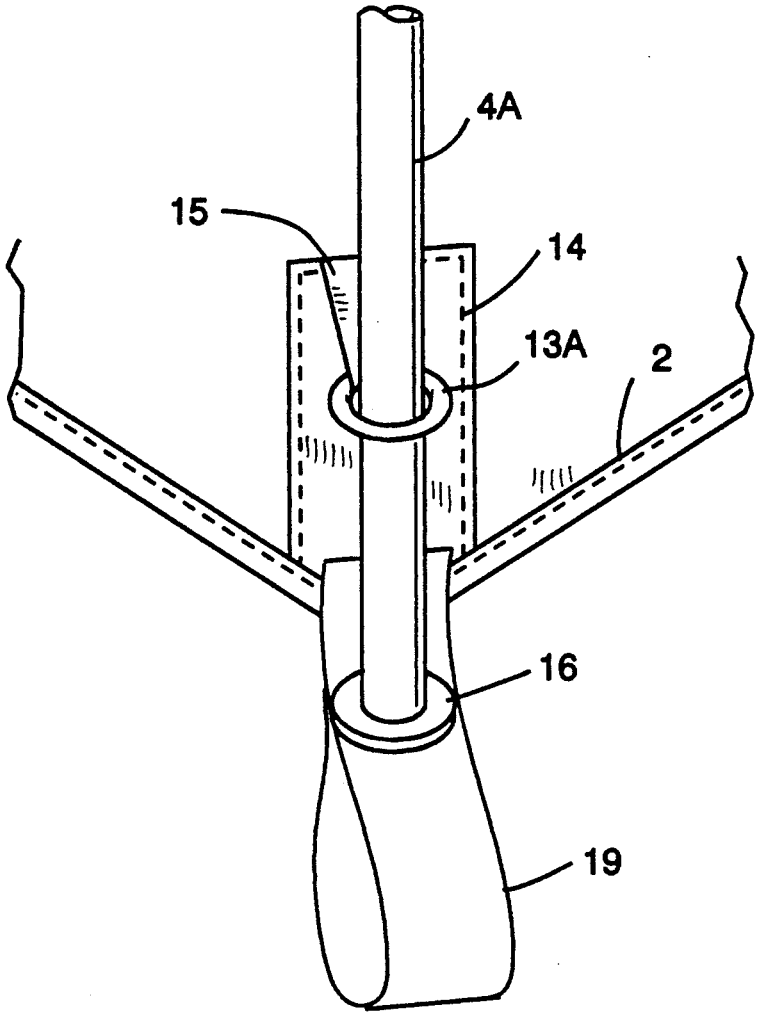
FIG. 4 is a perspective view of an embodiment of the invention illustrating how the flexible pole is attached to the membrane and is securely held in contact by means of pole tips and with one end of the pole remaining so attached even during disassembly and storage.

Reference is now made to FIG. 4 for a further understanding of the structure of FIG. 1. Here a guide ring 13*a* is shown attached to membrane 2 by means of flexible webbing 15. Guide ring 13*a* is located at the end of the path of O-rings through which pole 4*a* extends and guide ring 13*a* is located at least at the end of the O-ring path where pole 4*a* will be detached from membrane 2 when the tent is to be disassembled for storage. Guide rings 13*b* and *c* of FIG. 1 are similarly constructed and positioned along their respective O-ring paths as is guide ring 13*a*.

Thus, in FIG. 1, guide rings 13*a, b* and *c* are located at the end of each path of O-rings where the poles 4*a, b* and *c* are to be detached from membrane 2 for disassembly and storage. Preferably the flexible webbing 15 or other flexible material by which guide rings 13*a, b* and *c* are attached to membrane 2 is of a color different from that of membrane 2 and also different from the color of the material 20 used to attach the other O-rings 6 to membrane 2. Webbing 15 is also preferably of a color different from webbing 17 which acts as a reinforcement to the tent membrane at each end of poles 4*a, b* and *c*. This difference in color of the material by which guide rings 13*a, b* and *c* are attached to membrane 2 will allow for a quick and easy identification of guide rings 13*a, b* and *c* when tent 10 must be re-assembled from its disassembled state. That is, when it is desireable to re-assemble tent 10, a quick identification of guide rings 13*a, b* and *c* will assure that the proper O-ring will initially be released along the respective path of O-rings for a quick re-assembly of tent 10. Without guide rings 13*a, b* and *c* provided 5 for in the manner designated and illustrated in FIGS. 1 and 4, and subsequently in FIG. 2 to be discussed, any of O-rings 6 along the respective paths of O-rings could be initially released or pulled along flexible poles 4*a, b* and *c* when the tent is being re-assembled and thus not guaranteeing that the correct lead ring, i.e., guide rings 13*a, b* and *c*, will be the first ring pulled along the respective flexible poles so that the tent will be quickly and properly assembled by even an individual working alone.

Guide rings similar to rings 13*a, b* and *c* may also be located at the end of flexible poles 4*a, b* and *c* which may remain attached to membrane 2 when the tent is disassembled for storage; however, such guide rings are not needed when the tent remains partially assembled with one end of the poles attached to the membrane. Such additional guide rings may be useful for re-assembly of the tent when the poles are completely detached at both ends from the membrane.

Flexible poles 4*a, b* and *c* are preferably manufactured out of a strong and lightweight material such as aluminum and are preferably comprised of sections such as those illustrated by reference number 18 along poles 4*a, b* and *c*. With flexible poles 4*a, b* and *c* being so manufactured to include sections, the poles may be conveniently folded during storage, together with membrane 2 to allow for a compact backpack for transport by a single individual (see further discussion of FIG. 2 below.)

In a preferred embodiment of a tent constructed in accordance with the invention, a fully assembled and erected tent has a plurality of flexible poles 4*a, b* and *c* each of which is intersected with each of the other poles at various points of intersection which are illustrated by reference number 12 (FIG. 1) as poles 4*a, b* and *c* are extended radially across the circumference of tent membrane 2 to exert a radially outward force on membrane 2 for supporting membrane 2. At least one of the points of intersection 12 of flexible poles 4*a, b* and *c* has a retaining ring 8 or other suitable means employed for maintaining at least two of flexible poles 4a, b and c in their relative positions to each other during assembly and, more particularly, during disassembly of tent 10.

Figure 2:
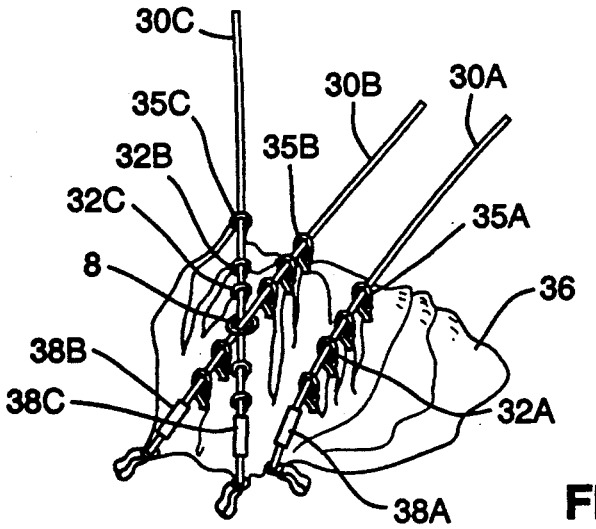
FIG. 2 illustrates the manner in which the membrane, suspended from flexible poles by O-rings, is slid along the flexible poles to one end of the poles for storage.

Turning now to FIG. 2, where illustration is made of how a tent constructed in accordance with the invention may be conveniently stored with flexible poles 30a, b and c being partially attached to membrane 36 during disassembly and storage. Specifically, membrane 36 which is attached to flexible poles 30a, b and c by means of a series of O-rings 32a, 32b and 32c and further by means of guide rings 35a, b and c. The series of O-rings 32a–32c, together with guide rings 35a, b and c, are slid along poles 30a, b and c with membrane 36 attached to the O-rings and to poles 30a, b and c to one section of each of poles 30a, b and c where O-rings 32a–32c and membrane 36 are prevented from completely sliding away from poles 30a, b and c by means of pole stops 38a, b and c. Pole stops 38a, b and c are located far enough from the ends of poles 30a, b and c to prevent the flexible webbing from becoming entangled around the ends of poles 30a, b and c which ends remain attached to poles 30a, b and c during disassembly and storage of the tent.

Retaining ring 8 (FIG. 1) also remains about the point of intersection of at least two of poles 30a, b and c (here ring 8 remains about poles 30b and c to maintain their intersecting position). Retaining ring 8 thus prevents flexible poles 30b and c from becoming uncrossed with each other and further maintains flexible poles 30a, b and c in their positions relative to each other. Ring 8 further operates to prevent the poles and the membrane from becoming entangled during disassembly and storage. By maintaining at least two of the poles in their proper intersecting relationship during disassembly, the third pole will readily assume its position during re-assembly when the two intersecting poles return to their proper position. Retaining ring 8 thus further allows for a quick re-assembly of the tent since the flexible poles are kept in their relative positions to each other during disassembly and storage of the tent.

Figure 6:
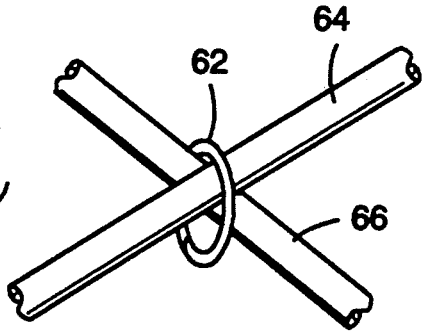
FIG. 6 illustrates how flexible poles of the inventive tent structure intersect at a point and are retained at the point of intersection by means of a retaining ring.

A further illustration of the manner in which the retaining ring 8 of FIG. 1 is employed to maintain the relative intersecting positions of at least two of flexible poles 4a, b and c is shown in FIG. 6 where retaining ring 62 is used to maintain flexible poles 64 and 66 in their relative positions both during assembly and disassembly of a tent. Again, during re-assembly of the tent the third flexible pole will readily return to its position when poles 64 and 66 are forced to assume their proper positions by ring 62. During disassembly of the tent, retaining ring 62 is slid together with membrane 36, O-rings 32a, b and c and guide rings 35a, b and c along poles 30a, b and c (see FIG. 2) when the tent is being disassembled for storage.

Figure 7:
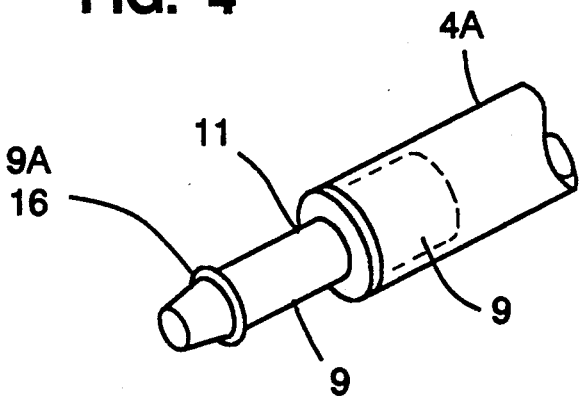
FIG. 7 further illustrates the attachment means of FIG. 4 for securely attaching the tent membrane to the flexible poles.

FIGS. 4 and 7 illustrate the preferred means for attaching flexible poles 4a, b and c of FIG. 1 to membrane 2. In this embodiment, membrane 2 is attached to each of the ends of poles 4a, b and c by means of a grommet 16 through which pole 4a is extended to receive a pole tip 9 securely in an internal cavity 11 of pole 4a. Stake loops 19 are provided to assist in the assembly of the tent and act as a mechanism for pulling the membrane into place.

Figure 5:
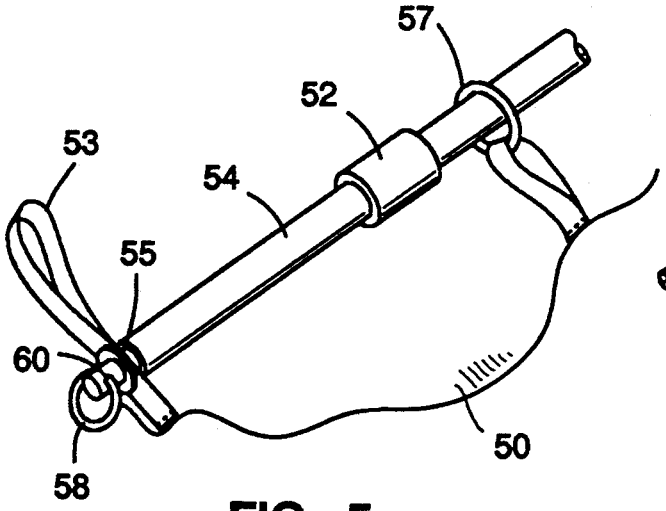
FIG. 5 is another perspective view of an embodiment illustrating a further means by which the tent membrane is attached to the flexible pole by means of O-rings and further how one end of the membrane may remain attached to the pole even during storage.

FIG. 5 illustrates another embodiment of the manner in which the ends of the flexible poles, here pole 54, is securely attached to membrane 50 by extending pole 54 through a grommet 55, which grommet is further attached to a stake loop 53. Pole 54 further has a cavity 60 through which a split ring 58 is extended to securely attach pole 54 to membrane 50. Further, pole stop 52 is located a distance from grommet 55 to prevent guide ring 57 and the other O-rings along the path from extending to and beyond the very end of pole 54 both during the assembly and disassembly of a tent. When it is desired to detach membrane 50 from pole 54, split ring 58 is removed to allow pole 54 to release membrane 50. Split ring 58 is then re-inserted into cavity 60 for safekeeping and later use.

Figure 3:
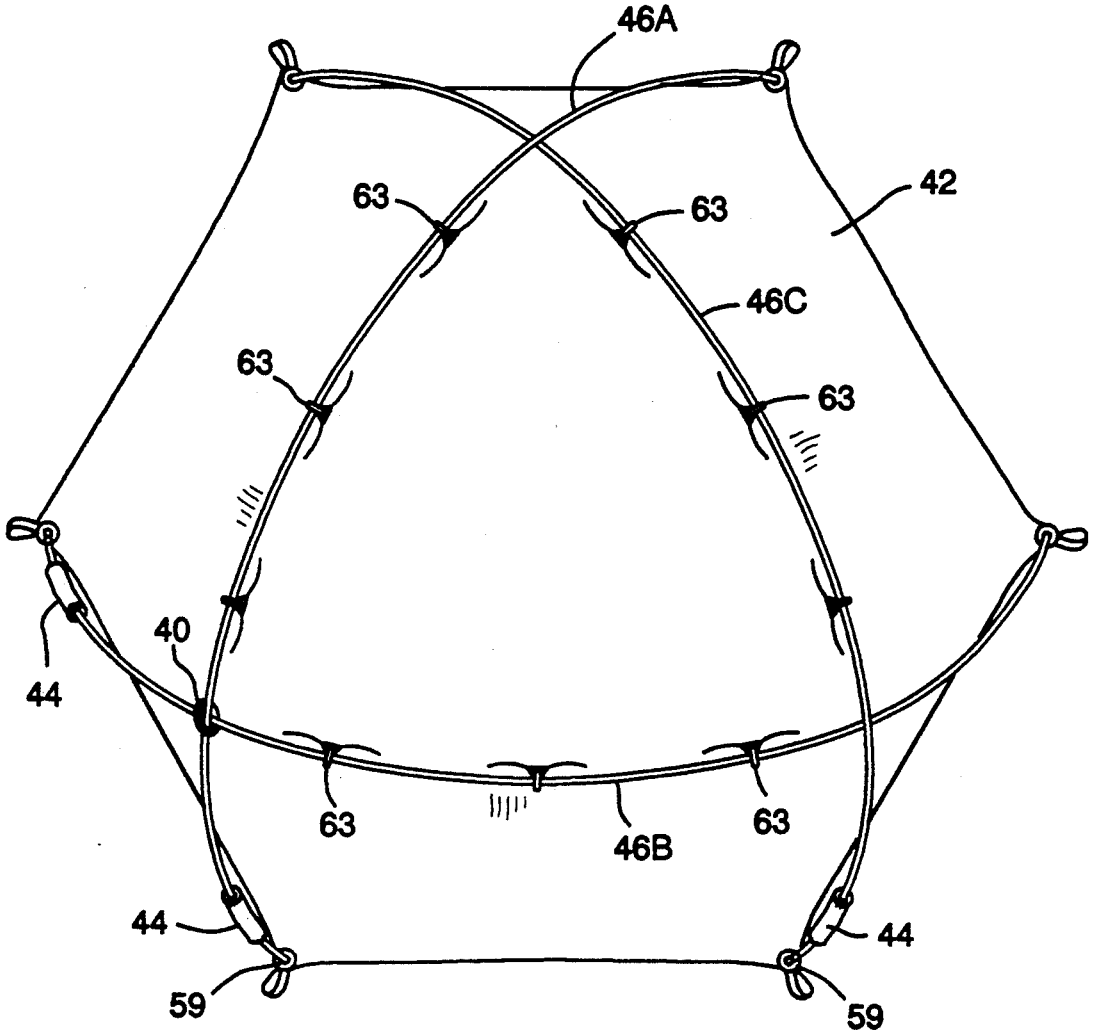
FIG. 3 is a top plan view of one embodiment of a tent constructed in accordance with the invention.

FIG. 3 is the plan view of a dome-type tent constructed in accordance with the invention and illustrates from this perspective what the tent looks like when membrane 42 is suspended from flexible poles 46a, b and c which poles exert a radially outward force on membrane 42 to form the dome-shaped tent structure. FIG. 3 further illustrates how retaining ring 40 is used to maintain the points of intersection of at least two of flexible poles 46a and b while the tent structure is erected as well as when it is in the collapsed and disassembled state for storage. Pole stops 44 are located a distance from grommet 59 to prevent O-rings 63 and the guide rings from sliding beyond the very end of the flexible pole which remains attached to membrane 42 during disassembly and storage.

The present invention has been disclosed with respect to certain specific embodiments only; however, it must be understood that various modifications and alternative embodiments which are apparent to one skilled in the art is intended to be included and encompassed within the scope of applicant's invention. For example, it is clearly anticipated that this invention may be equally useful and operable with a tent structure which employs a single flexible pole instead of the three poles discussed in connection with the preferred embodiment. Similarly, the tent membrane may be suspended from more than three poles and still fall within the scope and teachings of the invention. Further, a retaining ring or other retaining means may be employed at more than one point of intersection of the flexible poles where three or more poles are used. For these and other reasons, applicant intends that his invention will cover all obvious and apparent modifications and applicant further intends that his invention is only limited by the following claims.

I claim:

1. A self-contained and collapsible tent comprising:

a membrane, having a plurality of O-rings attached thereto and distributed along the outer surface of said membrane in at lest one path;

a continuous elongate flexible pole extending slidably and continuously through the O-rings of said path, said pole having oppositely disposed ends and said rings being freely slidable over the pole to positions closely adjacent each other at one end of the pole in the unassembled and collapsed state;

means for attaching the oppositely disposed ends of the pole to said membrane to maintain the pole in an arcuate condition with the membrane suspended therefrom such that said pole exerts a radially outward force on said membrane when said tent is assembled and erected and such that said one end of said pole remains attached to said membrane while said other end of said flexible pole is detached from said membrane when the tent is in the unassembled and collapsed state for storage.

2. A tent of the type set forth in claim 1 wherein said attaching means includes a grommet for receiving each end of said flexible pole, a cavity through each end of said flexible pole for receiving a pole tip for retaining said pole in said grommet and in attachment to said membrane.

3. A tent of the type set forth in claim 1 wherein said flexible pole includes sections which are foldably mounted one to the other such that when said tent is in the unassembled and collapsed state for storage, said sections of said flexible pole are folded for storage with said tent membrane.

4. A tent of the type set forth in claim 3 wherein all of said O-rings ar moved to at least one of said flexible pole sections located proximate said one end of said pole which remains attached to said membrane when the tent is in the unassembled and collapsed state for storage.

5. A tent of the type set forth in claim 1 wherein said O-rings are attached to said membrane by means of a flexible member such that said o-rings may be moved along said flexible pole when said flexible pole is extended through said path of O-rings.

6. A tent of the type set forth in claim 5 wherein said flexible member is a webbing such that said O-rings will slide along said flexible pole when the tent is to be unassembled and collapsed for storage.

7. A tent of the type set forth in claim 1 further including means disposed at a distance from said attaching means at said one end of said pole for preventing said O-rings from moving to said attaching means and being removed over said one end such that said O-ring and said flexible member will not become entangled about said flexible pole when said tent is in the unassembled and collapsed state for storage.

8. A self-contained and collapsible tent comprising:

a membrane, having a plurality of O-rings attached thereto and distributed along the outer surface of said membrane in a plurality of paths with each path spaced apart from each one of the other paths;

a plurality of continuous elongate flexible poles, each of said poles extending slidably and continuously through the O-rings of one of said paths and having oppositely disposed ends, said rings being freely slidable over the poles to positions closely adjacent each other at one end of each of the poles;

means for attaching the oppositely disposed ends of each of said flexible poles to said membrane to maintain the poles in an arcuate condition with the membrane suspended therefrom whereby the poles exert a radially outward force on said membrane when said tent is assembled and erected and such that said one end of each of said poles remains attached to said membrane when the other end thereof is detached from said membrane when the tent is in the unassembled and collapsed state for storage.

9. A tent of the type set forth in claim 8 wherein said attaching means includes a grommet for receiving each end of said flexible pole, a cavity through each end of said flexible pole for receiving a pole tip for retaining said pole in said grommet and in attachment to said membrane.

10. A tent of the type claimed in claim 8 wherein each of said flexible poles when extended through its associated path of O-rings, intersects with at lest one of the other flexible poles at at least one point along said tent membrane.

11. A tent of the type set forth in claim 10 further comprising a retaining means at at least one point where one of said flexible poles intersects with at least one of the other flexible poles, for maintaining the positions of said flexible poles at said point of intersection relative to each other.

12. A tent of the type set forth in claim 11, wherein the retaining means comprises a retaining ring through which the intersecting poles slidably extend.

13. A tent of the type set forth in claim 8 wherein each of said flexible poles includes sections which are foldably mounted one to the other such that when said tent is to be unassembled and collapsed for storage, said sections of said flexible poles are folded for storage with said tent membrane.

14. A tent of the type set forth in claim 13 wherein all of said O-rings are slid to at least one of said flexible pole sections located proximate the end of said pole which remains attached to said membrane when the tent is in the unassembled and collapsed state for storage.

15. A tent of the type set forth in claim 8 wherein said O-rings are attached to said membrane by means of a flexible member such that said O-rings may be moved along said flexible poles when said flexible poles are extended through said paths of O-rings.

16. A tent of the type set forth in claim 15 wherein said flexible member is a webbing such that said O-rings will slide along said flexible poles when the tent is in the unassembled and collapsed state for storage.

17. A tent of the type set forth in claim 8 further including means disposed a distance from said attaching means at said one end of each of said poles for preventing said O-rings from moving to said attaching means and being removed over said one end such that said O-rings and said flexible member will not become entangled about said flexible poles when said tent is in the unassembled and collapsed state for storage.

* * * * *